US008640281B2

(12) United States Patent
Frias

(10) Patent No.: US 8,640,281 B2
(45) Date of Patent: Feb. 4, 2014

(54) NON-INFLATABLE TEMPERATURE CONTROL SYSTEM

(76) Inventor: Jacobo Frias, Bronx, NY (US)

( * ) Notice: Subject to any disclaimer, the term of this patent is extended or adjusted under 35 U.S.C. 154(b) by 453 days.

(21) Appl. No.: 12/836,569

(22) Filed: Jul. 14, 2010

(65) Prior Publication Data

US 2011/0010850 A1 Jan. 20, 2011

Related U.S. Application Data

(60) Provisional application No. 61/226,712, filed on Jul. 18, 2009.

(51) Int. Cl.
*A47C 21/04* (2006.01)

(52) U.S. Cl.
USPC ..... 5/421; 5/423; 5/727; 5/730

(58) Field of Classification Search
USPC ..... 5/690, 724, 740, 652, 652.1, 652.2, 5/655.9, 941, 421–423, 726–730; 62/261; 219/217; 297/180.13, 180.14
See application file for complete search history.

(56) References Cited

U.S. PATENT DOCUMENTS 3,047,888 A * 8/1962 Shecter et al. ..... 428/218
3,939,508 A * 2/1976 Hall et al. ..... 5/727
4,057,861 A 11/1977 Howorth
4,185,341 A 1/1980 Scales
4,580,301 A * 4/1986 Ludman et al. ..... 5/724
5,022,111 A * 6/1991 Fenner, Sr. ..... 5/736
5,408,711 A 4/1995 McClelland
5,448,788 A * 9/1995 Wu ..... 5/421
5,555,579 A * 9/1996 Wu ..... 5/421
5,749,111 A 5/1998 Pearce
5,960,496 A * 10/1999 Boyd ..... 5/722
6,006,524 A 12/1999 Park
6,541,094 B1 * 4/2003 Landvik et al. ..... 428/71
7,036,173 B2 5/2006 Gladney
7,165,281 B2 1/2007 Larssson et al.
7,685,663 B2 * 3/2010 Rawls-Meehan ..... 5/719
7,810,194 B2 * 10/2010 Clenet ..... 5/694

* cited by examiner

*Primary Examiner* — Nicholas Polito

(57) ABSTRACT

A non-inflatable resting device used for heating and cooling is provided with a plurality of interconnected channels located close to an external surface of the resting device. Each channel substantially occupies the space between two support beams and the interior of said external surface. The comfort level of the resting devices is considerably increased while maintaining adequate structural integrity of the channels when the support beams are constructed with a cushion material having layers of different hardness levels. The top layer is a cushion material with high initial softness ratio. The arrangement of the channels and beams allows a non-pressurized conditioned fluid to flow underneath of the external surface providing a resting device with a heating and cooling system with unmatched energy efficiency. The high energy efficiency of the proposed resting device is due to the elimination of the compressor motor and the thick cushion layer used on the top surface as required by the competition. In addition, the ambient comfort level is improved by the elimination of a noisy compressor motor.

21 Claims, 5 Drawing Sheets

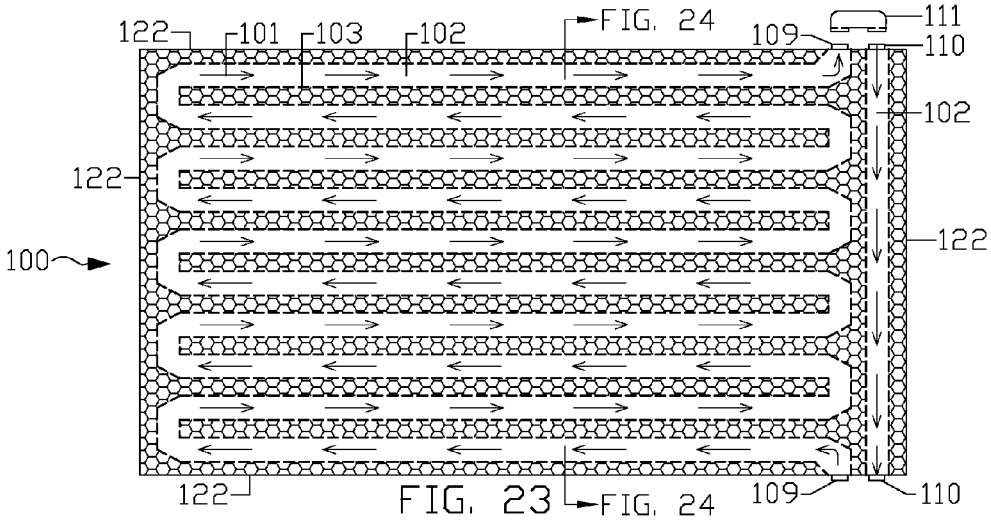
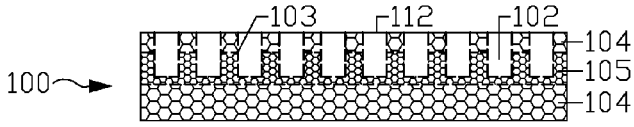
FIG. 24
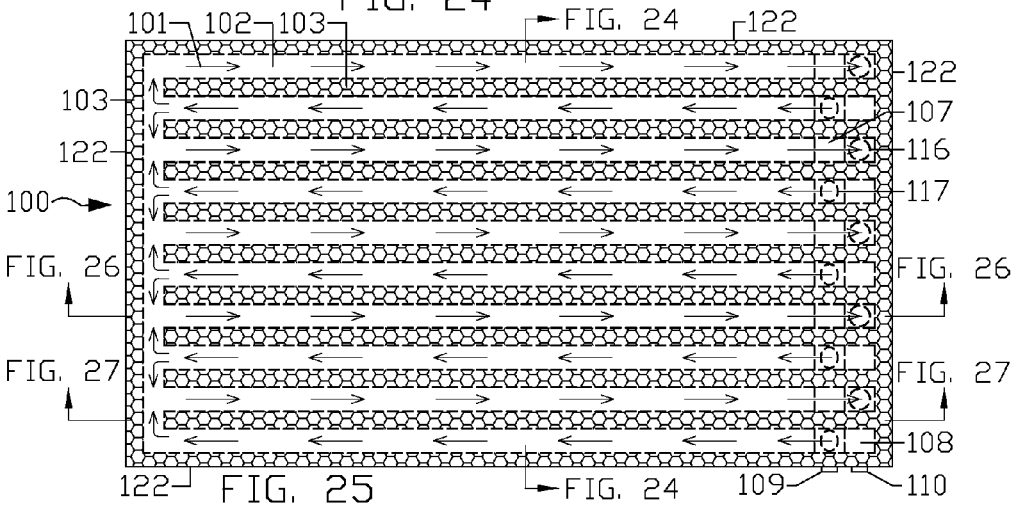
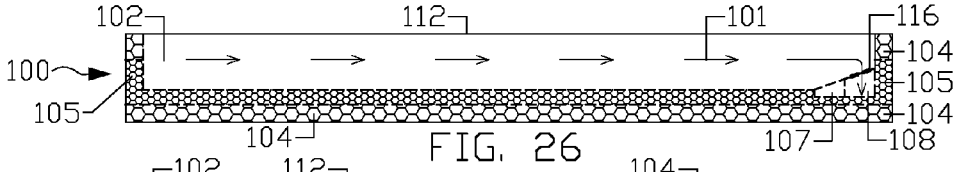
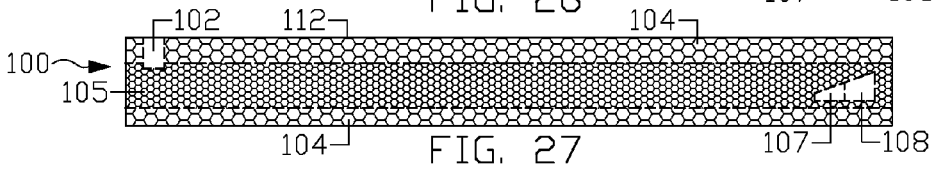

NON-INFLATABLE TEMPERATURE CONTROL SYSTEM

CROSS REFERENCE TO RELATED APPLICATIONS

This application claims priority from, and incorporates by reference the entirety of U.S. Provisional Patent Application Ser. No. 61/226,712 filed on Jul. 18, 2009.

BACKGROUND

1. Field

This invention relates generally to fluid flow within the body of non-inflatable resting devices, and more particularly, to temperature control systems for non-inflatable resting devices such as cushion mattresses and seating devices.

2. Prior Art

People spend several hours of each day sitting or laying down on a surface, including a bed (e.g., mattress, mattress pad, etc.) or a seat (e.g., office chair, sofa, seating pad, seating cushion, etc.) Since it is often desirable to manage and control the temperature of the surface that contacts the person (e.g., to remove the heat trapped in the contact area), several existing solutions attempt to cool or heat the contact surface or the person to improve personal comfort.

For example, sofas and other pieces of furniture incorporate electrical and mechanical equipment inside the furniture and below the surface to be heated or cooled. Similarly, thermal blankets and mattress pads incorporate electrical heating elements to heat the contact surface. In addition to increasing the cost and complexity of the mattress or seat, these systems also increase the risks of hazardous conditions such as fire and electric shock.

Other prior art solutions for heating and cooling of non-inflatable resting devices include the use of cushioned mattresses, pads, and seats with a plurality of hoses through which a conditioned fluid (i.e. water, air) is circulated under a relative thick cushion layer. The contact surface of the resting device is required to provide the users with sufficient comfort and to have thermal conductivity to allow adequate heating or cooling of the users resting on these devices. However, an acceptable trade-off between the mattress comfortability and the energy efficiency of the heating and/or cooling system has proven to be a difficult goal to obtain. Among others, the main drawbacks of these solutions are one or more of the following, 1) the conditioned fluid must be pressurized through the use of motor driven compressors because of the requirement of the conditioned fluid to support the users' weight, making these solutions less energy efficient and more expensive due to the use of special sealed-tight hoses and connections, 2) the contact surface is made relatively thick due to the comfort level requirement, which in turn, adversely affects the thermal conductivity between the user and the conditioned fluid, 3) typically, the materials from which the contact surface is made of do not satisfactorily comply with the required thermal conductivity and mechanical strength, 4) the above performance deficiencies of the system imply that if air is used as the conditioned fluid, it needs to be blown onto the users through a multiplicity of holes located in the contact surface, and as a consequence, the system cannot be configured to work in a closed loop, and finally 5) when the heating and cooling system is configured as a closed loop, a more thermally efficient conditioned fluid is usually used, i.e., water. The mentioned drawbacks can be found on today's most popular heating and cooling mattress and pads such as the "ChilliPad", "ChilliBed" and "CoolorHeat".

Consequently, there still is a market need for a non-inflatable resting device which can provides the users with a low-cost efficient heating and cooling while maintaining high comfort level.

DEFINITIONS

"Hardness" is defined as the resistance against pressure.

"Density" is the mass per unit volume. When density increases, hardness tends to increase.

"Tensile strength" is the resistance against stretching.

"Indentation Load Deflection" (ILD) factor is a hardness measurement defined in the ISO 2439 standard as the force that is required to compress a material a percentage of its original thickness, e.g., 25%, 40%, and 60% from its original thickness. And, these ILD's are designated as $ILD_{25\%}$, $ILD_{40\%}$, and $ILD_{60\%}$, respectively.

"Compression Load Deflection" (CLD) factor is a hardness measurement defined in the ISO 3386 standard as the counter pressure (force per surface) when the core material is pressed in 25% of its original thickness.

"Compression Modulus" (CM) or Sag Factor is defined by ISO 2439 standard as the ratio of $ILD_{65\%}$ to $ILD_{25\%}$. The Compression Modulus (CM) somewhat correlates with the perception of a person to whether the mattress supports a person's body with more uniform alignment.

"Initial Softness Ratio" (ISR) factor is a hardness measurement defined as the ratio of $ILD_{65\%}$ to $ILD_{5\%}$. The Initial Softness Ratio (ISR) somewhat correlates to the initial perception of a person about the comfort of the mattress.

"Human Two-Point Discrimination Threshold" is measured on a person's back when lying down on a resting device, and it is the minimum separation distance at which two objects may be distinguished when coming into contact with the skin. In the medical field that distance is recognized as approximately equals to 1 inch maximum.

The "Comfort Layer" is defined as a layer with high Initial Softness Ratio (ISR). The comfort layers are represented on the figures by a lower density hatch with a honey comb like pattern.

The "Support Layer" is defined as a foam layer with high Compression Load Deflection (CLD) factor. The support layers are represented on the figures by a higher density hatch with a honey comb like pattern.

"Bottoming out" refers to the collapse of a structure such that the top part of the structure substantially comes close or into contact with the bottom part as a response to an applied force.

The "Contact Surface" refers to any external surface of a resting device on which users rest. In this document the contact surface is referred to as the top surface.

SUMMARY

The requirement of a resting device made of a non-inflatable cushioned material for using pressurized conditioned fluid or a thick comfort layer through which heating and cooling is provided, is eliminated by configuring the resting device to have a plurality of interconnected channels through which a conditioned fluid flows substantially close to the contact surface of the resting device, where each of said channels substantially occupies the space between two support beams. The support beams provide structural strength to prevent the adjacent channels from bottoming out when subjected to weight loads. Additional strength and comfort are provided when each support beam is made out of a cushion material with non-uniform hardness levels. The top layer of the support beams is a comfort layer substantially close to the contact surface while the lower or bottom layers can have higher hardness levels in order to increase the structural strength of the support beams preventing the channels from bottoming out. In addition, the conditioned fluid can be configured to flow in a close loop without the need for motor driven compressors and special sealed tight connectors because the conditioned fluid flowing through the channels is not required to be pressurized.

BRIEF DESCRIPTION OF THE DRAWINGS

FIG. 23 is a top view of an embodiment of a ductless mattress with the top surface removed illustrating the channels connected to allow a single fluid flow.

FIG. 24 is a sectional view of the mattress shown in FIG. 23 along axis FIG. 24-FIG. 24.

FIG. 25 is a top view of an embodiment of a mattress with the top surface removed illustrating the channels connected to allow multiple fluid flows.

FIG. 26 is a sectional view of the mattress shown in FIG. 25 along axis FIG. 26-FIG. 26, illustrating a channel and two ducts.

FIG. 27 is a sectional view of the mattress shown in FIG. 25 along axis FIG. 27-FIG. 27, illustrating a support beam and two ducts.

DETAILED DESCRIPTION OF THE EMBODIMENTS

Figure 1:
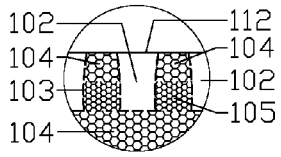
FIG. 1 is a partial sectional view illustrating a channel limited by an external surface and two support beams having a single support layer.
Figure 2:
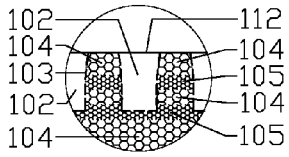
FIG. 2 is a partial sectional view illustrating a channel limited by an external surface and two support beams having a multiple support layers.
Figure 3:
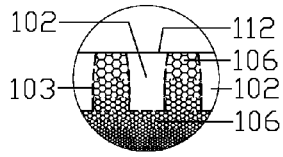
FIG. 3 is a partial sectional view illustrating a channel limited by an external surface and two support beams having gradual change in hardness level.
Figure 4:
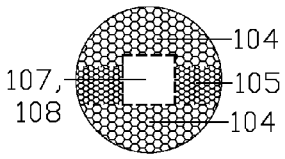
FIG. 4 is a partial sectional view illustrating a duct with sidewalls having a single support layer.
Figure 5:
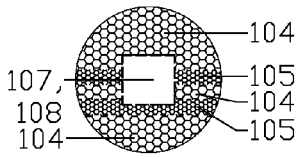
FIG. 5 is a partial sectional view illustrating a duct with sidewalls having multiple support layers.
Figure 6:
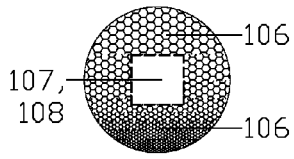
FIG. 6 is a partial sectional view illustrating a duct with sidewalls having gradual change in hardness level.

FIG. 1, FIG. 2, and FIG. 3 are sectional views illustrating three embodiments of the support beams 103, while FIG. 4, FIG. 5, and FIG. 6 are sectional views illustrating three embodiments of the duct 107 (108). The weight of a user lying down on the top surface 112 can be supported by the support beams 103. When properly designed, the support beams 103 can behave like a spring and react to the applied weight in such a way as to prevent the channels 102 from bottoming out. The support beams 103, the channels 102 and duct 107 (108) can be constructed out of a foam material with uniform hardness level. The problem of a mattress 100 having support beams 103 made of a foam having uniform hardness level, is that, if the foam material has low density or is too soft, the support beams 103 can collapse allowing the bottoming-out of the channels 102, and substantially blocking the flow of the conditioned air 101. On the contrary, if the hardness level of the foam material is increased to make it less compressible, the body pressure points increase making it more difficult for users to rest comfortably. As a result, a satisfactory trade-off between comfortability of the mattress 100 and structural integrity of the support beams 103 is more difficult to obtain by using support beams 103 having uniform hardness level.

The solution for designing the support beams 103 with structural integrity while having a foam mattress 100 with high comfort level is to provide the support beams 103 with a foam material with non-uniform hardness levels. As shown in FIG. 1, the top of the support beams 105 comprises a comfort layer 104 while a support layer 105 is added below. The comfort layer 104 has a higher Initial Softness Ratio (ISR) in order to provide users with comfort while the support layer 105 below provides the support beams 103 with structural integrity preventing the channels 102 from bottoming-out. If bottoming-out occurs, the channels 102 can be substantially blocked greatly decreasing the flow of the conditioned air 101 and the performance of the heating and cooling system. Bottoming-out of the channels 102 is a condition to be avoided and accounted for in the mattress design stage.

FIG. 1 illustrates a channel 102 conveniently located below the top surface 112 on which users lie down to rest, and between two support beams 103 having a foam material with a support layer 105 sandwiched between two comfort layers 104. This embodiment follows the criteria of having a top layer with high Initial Softness Ratio (ISR) while the layer below has higher hardness level preventing the support layers 105 from collapsing and avoiding bottoming-out of the channels 102. FIG. 2 and FIG. 3 illustrate additional embodiments of the support beams 103. FIG. 2 illustrates the support beams 103 comprising multiple support layers 105. FIG. 3 illustrates the support beams 103 made of a foam material having gradual change in hardness level. The top of the support beams 103 is a foam material having high Initial Softness Ratio (ISR) while the deeper foam has gradual increase in hardness levels.

FIG. 4, FIG. 5, and FIG. 6 show embodiments of a duct 107 (108). The duct 107 (108) connects with the channels 102 and is used to transport the conditioned air 101 within the interior of the mattress 100. As opposed to the channels 102, a duct 107 (108) is located away from the external surfaces of the mattress 100. The sidewalls of the duct 107 (108) counteract the weight applied on the top surface 112 preventing the ducts from bottoming out. FIG. 4 illustrates a duct 107 (108) with sidewalls constructed out of a foam material having a support layer 105 sandwiched between two comfort layers 104. FIG. 5 illustrates another embodiment of a duct 107 (108) with sidewalls made of a foam material having multiple support layers 105. While FIG. 6 shows another embodiment of a duct 107 (108) with sidewalls built with a foam material having gradual change in hardness levels.

Even though the description of the figures depicts the cushion material from which the mattress 100 is made as being of the polymer type foam, other types of cushion materials can also be used and are within the scope of the invention. For instance, cushion materials used for the construction of the resting devices can be one or more thermoplastic polymers, natural or synthetic fibers such as polyurethane, vinyl PVC (polyvinyl chloride), latex, polyethylene, nylon, rubber, neoprene rubber, cotton, wool, etc., and similar materials used in cushion mattresses. The top surface 112 can be made of Nylon, Lycra, Cotton, Polyester or similar materials with small thickness (approximately between 5 mils and 20 mils) so as to promote heat transfer. In addition to a smaller thickness, the heat transfer characteristic of the top surface 112 can be improved by using materials made of heat-conductive polymers. Adding conductive fillers increases the thermal conductivity of these polymers. For instance, some compounds used as conductive fillers are graphite fibers and silver, among others. In one embodiment (not shown) the top surface 112 can be made detachable for washing purposes. A flocking material made of, e.g., cotton, rayon, nylon, etc., can also be applied to the top surface 112 to provide additional comfort. Although the embodiments disclosed in the application use air as the conditioned fluid, a person of ordinary skill in the art would understand that a variety of other gases or liquids can be used to perform this function and they are within the intent and scope of the invention.

The technique for making foam materials with different hardness levels is known prior art and it is not covered in this document. The required hardness levels of the support layer 105 and the Initial Softness Ratio (ISR) of the comfort layer 104 can be determined based on factors such as the height, width, and comfortability of the support beams 103, and the channels 102 minimum unobstructed crossed-sectional area to be maintained under a user's maximum weight, etc.

The width of the conditioned air channels 102 is limited by the maximum separation distance between two adjacent support beams 103 for which a person may feel uncomfortable. If the support beams 103 are placed at a distance equal or greater than the "human two-point discrimination threshold", then, the pressure points at each support beam 103 increase making the mattress 100 uncomfortable. However, the top surface 112 aids in the supporting role of a person's body, significantly increasing the minimum threshold distance.

Figure 7:
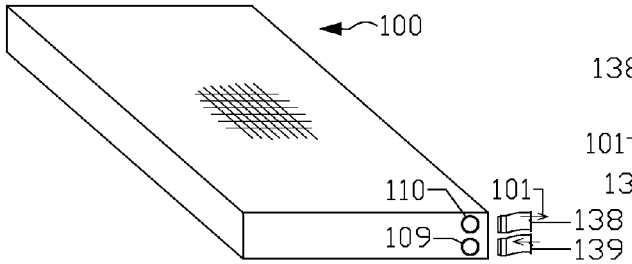
FIG. 7 is a perspective view of a mattress showing the connection with the supply and return hoses.

FIG. 7 is a perspective view of the mattress 100 connected to the return and supply hoses 138, 139 respectively. The hoses 138, 139 can be constructed of flexible thermoplastic polymers and should possess sufficient structural strength to maintain an open cross section. In addition, the materials used for the hoses 138, 139 have poor heat transfer characteristic (i.e., low thermal conductivity) to minimize the heat losses between the conditioned air 101 (flowing through the hoses) and the environment.

Figure 8:
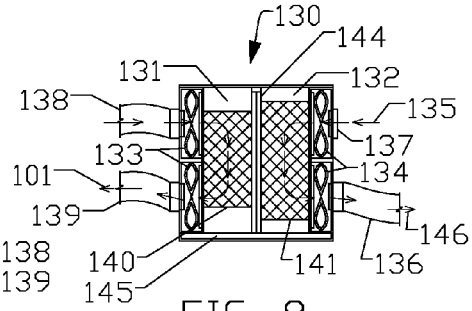
FIG. 8 is a sectional view illustrating an embodiment of the heating and cooling unit.

FIG. 8 illustrates one embodiment of the heating and cooling unit 130. The heating and cooling unit comprises a thermoelectric heat pump 144 also known as a Peltier module, which is widely used as a solid state heat pump for mattress heating and cooling applications. The thermoelectric heat pump 130 can comprise two air chambers 131, 132 each including a heat exchanger 140, 141 respectively. The air chambers 131, 132 can each be provided with a pair of ventilation fans 133, 134. The fans can also be integrated with the thermoelectric heat pump unit similar to model number MAA150T-24 as manufactured by Melcor. In one embodiment (not shown), the air cambers 131, 132 each can be provided with just a fan similar to model number AA-150-24-22 as manufactured by Melcor.

When a DC current passes through the thermoelectric heat pump 144, the conditioned air heat exchanger 140 cools down while the ambient air heat exchanger 141 heats up. On the contrary, if the DC current reverses polarity, the conditioned air heat exchanger 140 heats up while ambient air heat exchanger 141 cools down. In a cooling operation, when the conditioned air 101 passes through the conditioned air chamber 131, heat is transferred from the conditioned air 101 to a lower temperature heat exchanger 140, thereby cooling the conditioned air 101. As the ambient air 135 passes through the air chamber 132, heat is transferred from a higher temperature heat exchanger 141 to the ambient air 135, thereby cooling the heat exchanger 141. On the other hand, the heating operation is performed by reversing the polarity of the voltage applied to the thermoelectric heat pump 144. The temperature of the conditioned air heat exchanger 140 increases and the temperature of the ambient air heat exchanger 141 decreases. In an embodiment (not shown), the addition of a heating device in the air chamber can provide additional heating as well as humidity and moisture control functions. Water reservoir 145 can be provided for collecting the moisture due to condensation in the air chambers.

Figure 9:
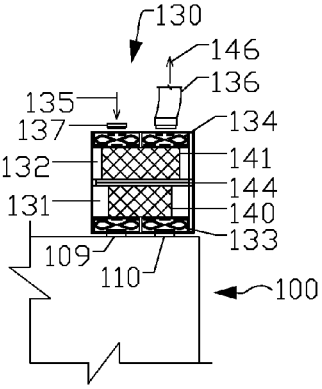
FIG. 9 is a sectional view of another embodiment of a heating and cooling unit attached to the mattress.

In another embodiment of the heating and cooling unit 130 shown in FIG. 9, the hoses 138, 139 are not used as the heating and cooling unit 130 is attached directly to the mattress 100 via the openings 109, 110. This embodiment can also be provided with an external power supply to make the heating and cooling unit 130 more compact.

Figure 10:
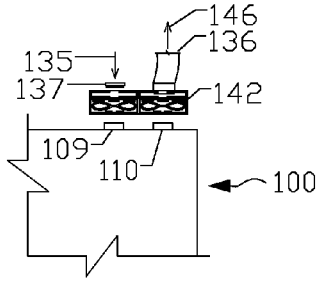
FIG. 10 is a sectional view of an embodiment illustrating a ventilation unit attached to the mattress.

FIG. 10 illustrates another embodiment using a ventilation fan unit 142 connected directly to the mattress 100 via the openings 109, 110. The embodiment shown in FIG. 10 can be used in environments where the ambient air can provide some level of cooling. The ambient air can be used to provide cooling of the top surface 112 by removing the trapped body heat through the top surface 112. In the embodiment depicted in FIG. 10, ambient air is drawn into the supply opening 109 by the ventilation fan unit 142, circulates through the mattress 100 and returns out of the mattress as exhaust air 146 through the exhaust air hose 136 in an open-loop configuration. This embodiment can also be used for removing moisture from the channels 102 after use.

Figure 11:
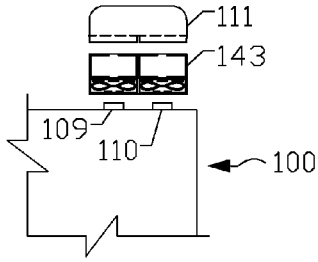
FIG. 11 is a sectional view of an embodiment illustrating an embodiment of a heating unit attached to the mattress.

FIG. 11 illustrates another embodiment where a simpler heating unit 143 is used. This embodiment is similar to the embodiment of FIG. 10 except that a heating device (not shown) is enclosed within the heating unit 143. This embodiment can also be used in a closed-loop air flow configuration by connecting a jumper 111 that reroutes exhaust air 146 back into the mattress 100. Such an embodiment requires minimal power consumption during heating operation.

Figure 12:
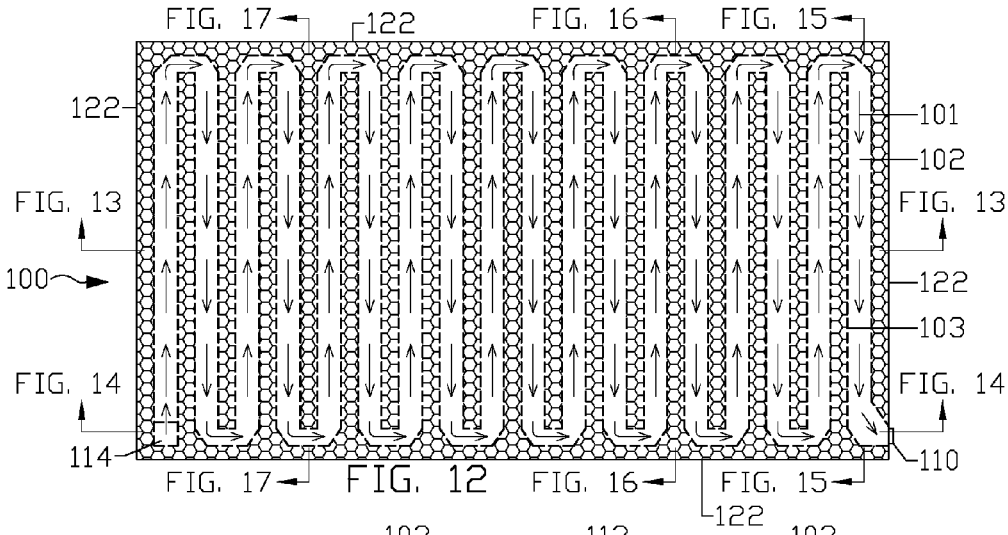
FIG. 12 illustrates a top view of a mattress with the top surface removed and the channels connected to allow a single fluid flow.
Figure 13:
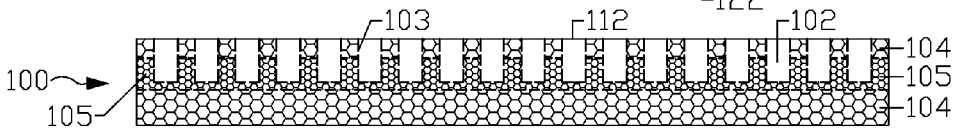
FIG. 13 is a sectional view of the mattress shown in FIG. 12 along axis FIG. 13-FIG. 13 illustrating a single support layer.
Figure 14:
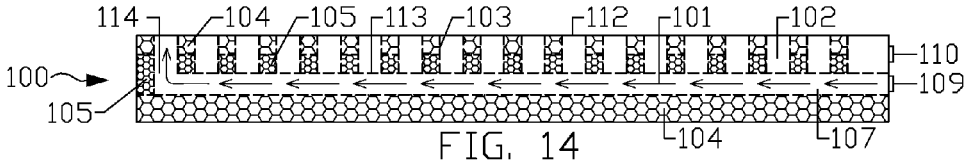
FIG. 14 is a sectional view of the mattress in FIG. 12 along axis FIG. 14-FIG. 14 illustrating a duct.
Figure 15:
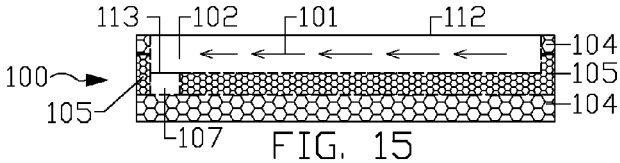
FIG. 15 is a sectional view of the mattress in FIG. 12 along axis FIG. 15-FIG. 15 illustrating a channel.
Figure 16:
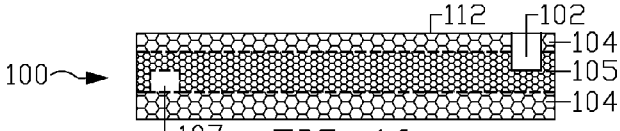
FIG. 16 is a sectional view of the mattress in FIG. 12 along axis FIG. 16-FIG. 16 illustrating a support beam.
Figure 17:
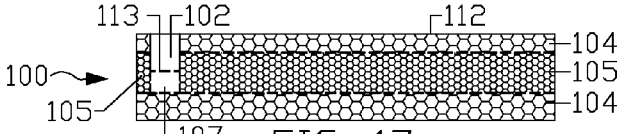
FIG. 17 is a sectional view of the mattress in FIG. 12 along axis FIG. 17-FIG. 17 illustrating another support beam.

FIG. 12 shows a mattress 100 with the top surface 112 removed. FIG. 12 illustrates an embodiment of the inventive concept with the channels 102 interconnected to allow a single flow of the conditioned fluid 101. FIG. 13 and FIG. 14 are sectional views of the mattress 100 shown in FIG. 12. These figures show the support layer 105 as part of the sidewalls of the channels 102 and the duct 107. FIG. 15 is a sectional view illustrating a channel 102. FIG. 16 and FIG. 17 are sectional views illustrating support beams 103.

In accordance with the inventive concept, interconnected channels 102 are formed next to the top surface 112 of the mattress 100 and substantially extend between two sides defining the perimeter of the external surface. The conditioned air 101 can be supplied to the mattress 100 through the supply opening 109 (see FIG. 14), then through the supply duct 107, through which the conditioned air 101 passes up through the interior opening 114 (see FIG. 12) and into the channels 102. Similarly, the conditioned air 101 can return (or exit) from the mattress 100 through the channels 102 and discharged out through the return opening 110. The configuration of the interior opening, ducts, and channels allows the conditioned air 101 to be received into the mattress 100 by the supply opening 109 and discharged from the return opening 110. The volume of each channel 102 and each duct 107 (108) has a geometric ratio such that its length divided by the equivalent of the diameter of its cross -sectional area is greater than three. A person of ordinary skill in the art will understand that a variety of supply and return channel and duct configurations are within the spirit and scope of the invention. For instance, the mattress 100 shown in FIG. 12 can have two separate comfort zones (not shown) to simultaneously enable two users to adjust for two different temperature levels of the top surface 112. The latter can be implemented by furnishing each half of the mattress 100 with a separate plurality of channels 102 and beams 103, and each plurality having its own conditioned air 101.

Although the embodiments have been described with the conditioned air 101 being supplied to the foam mattress 100, via the supply hose, ducts, and openings and returning using the return hose, ducts, and openings, the system can instead be configured to supply conditioned air 101 via the described return path and return via the described supply path. As the conditioned air 101 travels from the supply opening 109 through the mattress 100, by the time it returns to the return opening 110, it will be less cool (or less hot) compared to when it entered the resting mattress 100 due to the heat transfer process. This difference in temperature results in a top surface 112 having areas with significantly different temperature levels. In one embodiment, this situation is mitigated by periodically (i.e., after the expiration of a predetermined time interval) reversing the flow direction of the conditioned air 101.

The supply and return hoses 109, 110 can be attached to the supply and return openings 109, 110, respectively. The other ends of the supply and return hoses connect to the heating and cooling unit 130.

Figure 18:
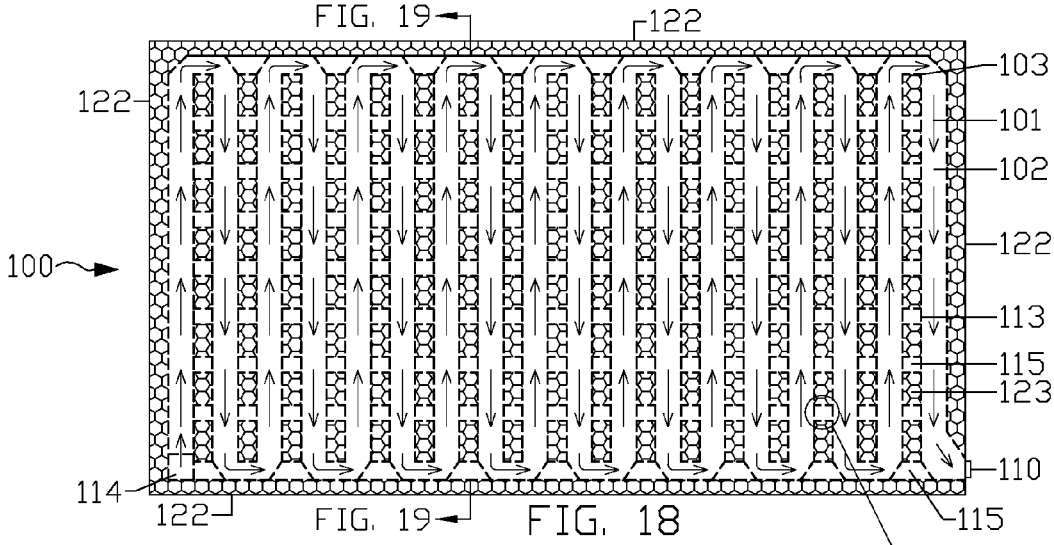
FIG. 18 is a top view of a mattress with the top surface removed illustrating another embodiment of the support beams and the channels connected to allow a single fluid flow.
Figure 19:
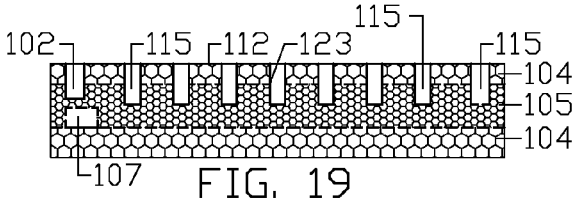
FIG. 19 is a sectional view of the mattress shown in FIG. 18 along axis FIG. 19-FIG. 19 illustrating a support beam comprising rectangular support columns.
Figure 20:
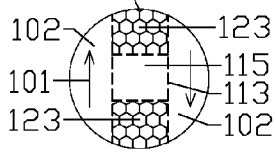
FIG. 20 is an enlargement of a typical air pocket between two rectangular support columns.
Figure 21:
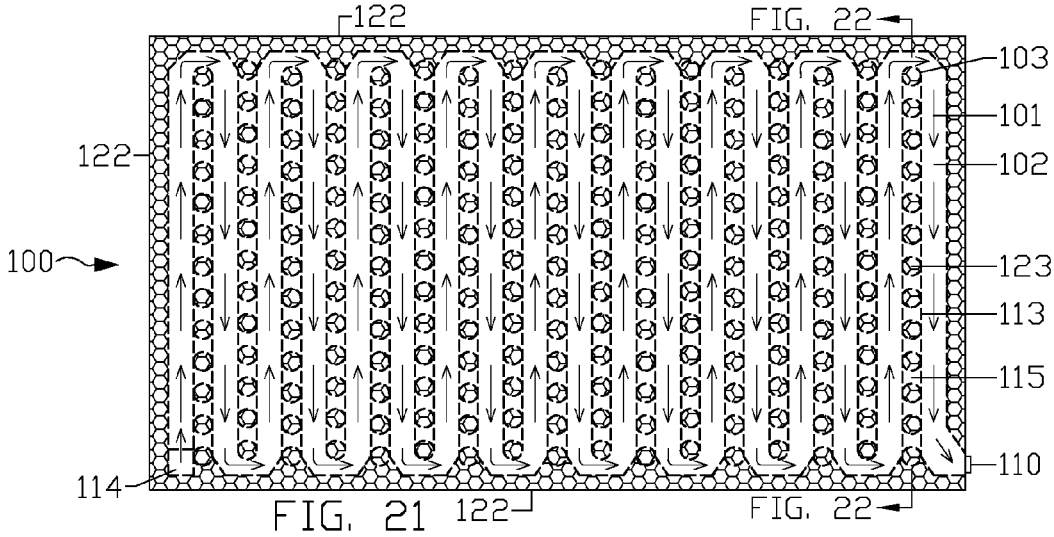
FIG. 21 is a top view of a mattress with the top surface removed illustrating another embodiment of the support beams and the channels connected to allow a single fluid flow.
Figure 22:
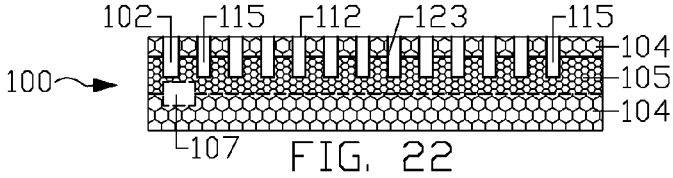
FIG. 22 is a sectional view of the mattress shown in FIG. 21 along axis FIG. 22-FIG. 22, illustrating a support beam comprising cylindrical support columns.

FIG. 18 and FIG. 21 show single-flow mattresses 100 illustrating additional embodiments of the support beams 103 formed by a plurality of support columns 123 and air pockets 115. The support columns 123 can be of any shape. For instance, FIG. 18 illustrates rectangular support columns 123 while FIG. 21 illustrates cylindrical support columns 123. Each support column 123 is separated from the next by an air pocket 115. As shown FIG. 20, two bridging films 113 connect the sidewalls of the adjacent support columns 123 making the channels 102 continuous and preventing the conditioned air 101 from moving through the air pockets 115.

FIG. 23 shows a single-flow ductless mattress 100 with the channels 102 and support beams 103 oriented along the longest axis of the mattress. The connecting jumper 111 completes the flow path of the condition air 101 and allows the hoses 109, 110 to be located on the same side of the mattress.

FIG. 25 shows another embodiment of the mattress 100 where the channels 102 and ducts 107, 108 are interconnected to allow multiple flows of the conditioned air 101 below the top surface 112. If the conditioned air 101 enters through the supply opening 109, the supply duct 107, and the channels 102, then, it returns through the channels 102, the return duct 108, and exits through the return opening 110, and vice versa. FIG. 26 illustrates a channel 102 connected to a return duct 108. FIG. 27 illustrates a support beam 103 formed by a support layer 105 located between two comfort layers 104.

Figure 28:
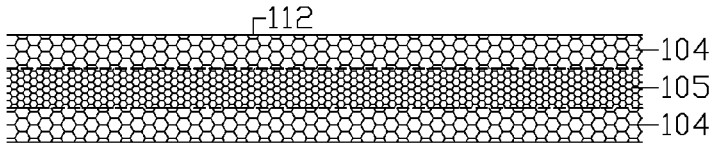
FIG. 28 is a sectional view of a support beam illustrating a continuous support layer sandwiched between two comfort layers.
Figure 29:
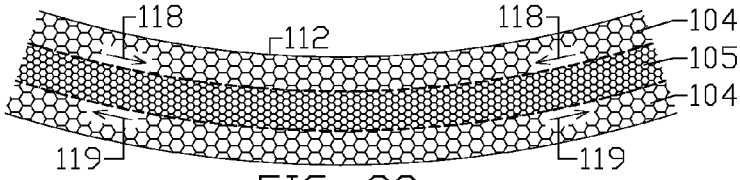
FIG. 29 illustrates the support beam of FIG. 28 subjected to weight loads.

FIG. 28 illustrates a support beam 103 having a continuous support layer 105 when no weight is applied on the top surface 112. As shown in FIG. 29, when a support beam 103 with a continuous support layer 105 is subjected to weight loads, compression forces 118 and tensile forces 119 are generated within the continuous support layer 105 creating body pressure points which in turn decrease the comfort level of the mattress 100. The comfort level of the mattress can be improved if the support layer 105 is divided in segments 120. The relative movement of the segments 120 with respect to each other minimizes the stiffness of the support layer 105 by minimizing the compression and tensile forces 118, 119 respectively.

Figure 30:
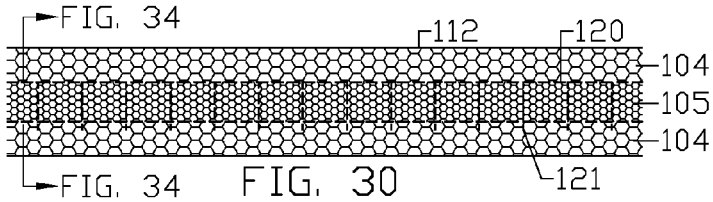
FIG. 30 is a sectional view of a support beam illustrating a segmented support layer.
Figure 31:
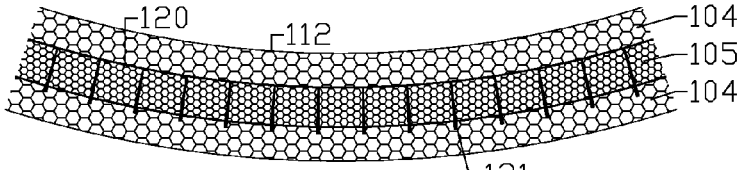
FIG. 31 illustrates the support beam of FIG. 30 subjected to weight loads.
Figure 32:
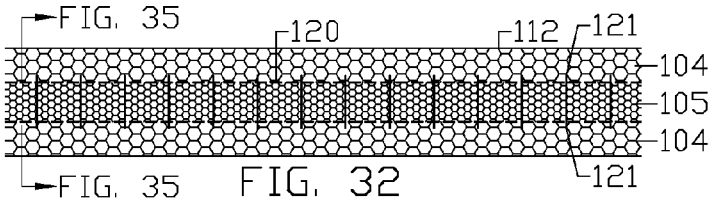
FIG. 32 is a sectional view of a support beam illustrating another embodiment of a segmented support layer.
Figure 33:
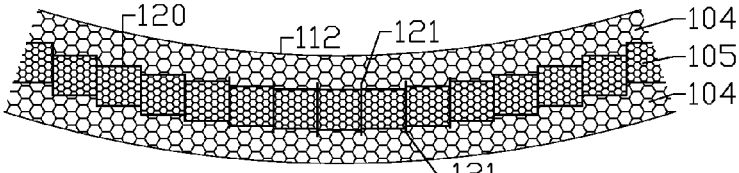
FIG. 33 illustrates the support beam of FIG. 32 subjected to weight loads.

FIG. 30 illustrates an embodiment of the segments 120 of the support layer 105. This embodiment can be implemented by attaching the top surface of each segment 120 to a flexible film (not shown) located between the support layer 105 and the upper comfort layer 104. The film can be made of a flexible thermoplastic or fiber type materials. As shown in FIG. 31, the function of this film is to work as a hinge between two adjacent segments 120 to mitigate the effects of the tearing forces on the upper comfort layer 104. FIG. 32 illustrates another embodiment where the support layer 105 is partitioned and attached to the top and bottom comfort layers 104. FIG. 33 illustrates the vertical shifting of the segments 120 when the top surface 112 is subjected to weight loads.

Figure 34:
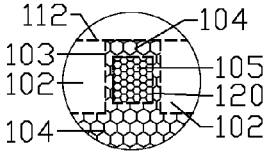
FIG. 34 shows a section of a support beam illustrating a support layer embedded into the comfort layer.

The tearing forces exerted on the comfort layers 104 due to the relative movement among the segments 120 are also mitigated by providing small incisions 121 on the comfort layers 104. FIG. 30 and FIG. 31 show the incisions 121 being made into the bottom comfort layer 104 to allow the segments 120 to swing open at the bottom. While FIG. 32 and FIG. 33 show the incisions 121 made at the top and bottom comfort layers 104 to ease the vertical shifting of the segments 120. FIG. 34 illustrates an embodiment of a support layer 105 embedded into the comfort layer 104, while FIG. 35 illustrates the support layer 105 attached to the top and bottom comfort layers 104.

Figure 35:
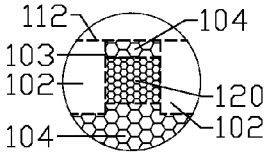
FIG. 35 shows a section of support beam illustrating a non-embedded support layer.

A film can be attached to each sidewall of the support beam 103 shown in FIG. 35 to prevent the conditioned air 101 from moving across the openings created by the swinging of two adjacent segments 120, making the channels 102 continuous.

As opposed to providing heating and cooling through a thick comfort layer on top of the mattress 100, the heat transfer of the mattress 100 occurs through a thin top surface 112 allowing for higher thermal efficiencies. The conditioned air 101 flowing through the channels 102 can provide an efficient comfort zone a few inches above the top surface 112. The comfort zone is proportional to the temperature of the top surface 112. The conditioned air 101 flowing in the channels 102 provides this comfort zone by conducting heat toward (when using heated conditioned air 101) or away (when using cooled conditioned air 101) from the top surface 112, thereby heating or cooling the immediate vicinity or any user resting on the top surface 112. A desirable range for a comfort zone where most persons feel comfortable lies in the range between 25° C. and 30° C.

The described embodiments of the mattress 100 incorporate an impermeable top surface 112 to keep the conditioned air 101 from escaping the channels 102. The top surface 112 creates a comfort zone largely in the form of convection heat moving through the top surface 112. In other embodiments (not shown) employing a porous top surface 112, the conditioned air 101 can be allowed to leak from the channels 102 through the top surface 112 providing additional cooling or heating of the comfort zone. Compared to an impermeable top surface 112, a system with a porous top surface can provide higher rate of heat transfer but at the cost of lower energy efficiency as it allows the conditioned air 101 to escape.

The channels 102 can be made smoother by applying a coating or using a film to cover the sidewalls of the support beams 103. A smooth sidewall minimizes flow turbulences and pressure drop losses. In addition, the described figures show the channels 102 with rectangular form, but, they can also have other shapes such as elliptical, circular, triangular, etc.

The design simplicity of mattress 100 lends itself for high productivity manufacturing process lowering production costs per mattress unit. The mattress 100 can be constructed from a single foam piece with dimensions equal to the mattress, and then, the channels 102 can be made by a cut out process. The mattress 100 can also be constructed by using a lower height foam piece, and then, the support beam 103 can be attached on top.

This written description uses examples to disclose the invention, including the best mode, and also to enable any person skilled in the art to make and use the invention. The patentable scope of the invention is defined by the claims, and may include other embodiments that are evident to those skilled in the art. Such other embodiments are intended to be within the scope of the claims if they have structural elements that do not differ from the literal language of the claims, or if they include equivalent structural/functional elements with insubstantial differences from the inventive concept being claimed.

What is claimed is:

1. An apparatus capable of providing heating and cooling through a layer acting as the contact surface of said apparatus, the apparatus consisting of a non-inflatable resting device comprising:

a means comprising a path having sidewalls located within the device to allow a fluid to enter, flow through, and exit the device;

the path substantially running along a plane parallel to the contact surface;

the sidewalls comprising a base layer and a cushion material having changes in hardness in a direction perpendicular to said contact surface; and said hardness changes in such a way as to avoid bottoming out of the path when a force acts on the contact surface.

2. The apparatus of claim 1, wherein said changes in hardness are discrete.

3. The apparatus of claim 1, wherein said changes in hardness are gradual.

4. The apparatus of claim 1, wherein the device is interconnected to a unit comprising means for forcing the fluid through the path such that the fluid exiting the unit enters the device.

5. The apparatus of claim 4, wherein the unit further comprises a means for exchanging heat with the fluid such that the fluid exiting the device enters the unit.

6. The apparatus of claim 1, wherein the contact surface is replaceable.

7. The apparatus of claim 1, wherein the sidewalls comprise a segmented cushion material.

8. An apparatus capable of providing heating and cooling through a layer acting as a contact surface, the apparatus consisting of a non-inflatable resting device comprising:

a plurality of beams comprising a bottom layer and running substantially parallel to the contact surface, wherein each beam comprises a cushion material having discrete changes in hardness in a direction perpendicular to said contact surface;

a plurality of channels, wherein each channel substantially occupies the space between two beams and said layer; and a means to allow a fluid to enter, flow through, and exit the device, and the means comprising a path formed by interconnecting the channels of said plurality; and said hardness changes in such a way as to avoid bottoming out of the channels when the contact surface is subjected to a load.

9. The apparatus of claim 8, wherein each beam comprises a plurality of columns formed with a cushion material having discrete changes in hardness along the height of said columns.

10. The apparatus of claim 8, wherein the device is interconnected to a unit comprising means for forcing the fluid through the path such that the fluid exiting the unit enters the device.

11. The apparatus of claim 10, wherein the unit further comprises a means for exchanging heat with the fluid such that the fluid exiting the device enters the unit.

12. The apparatus of claim 8, wherein the contact surface is detachable.

13. The apparatus of claim 8, wherein the device further comprises a duct substantially located within the device and connected to said plurality of channels in such a way as to form a path with sidewalls having discrete changes in hardness and capable of allowing the fluid to flow.

14. The apparatus of claim 8, wherein the beams of said plurality comprise a segmented cushion material.

15. An apparatus capable of providing heating and cooling through an external layer acting as a contact surface, the apparatus consisting of a non -inflatable resting device comprising:

a plurality of beams comprising a support layer and running substantially parallel to the contact surface, wherein each beam of said plurality comprises a cushion material having gradual changes in hardness in a direction perpendicular to said contact surface;

a plurality of channels, wherein each channel substantially occupies the space formed between two beams and the external layer; and a means to allow a fluid to enter, flow through, and exit the device, wherein the means comprises a path formed by interconnecting the channels of said plurality; and said hardness changes such that bottoming out of the channels is avoided when the contact surface is subjected to a force.

16. The apparatus of claim 15, wherein the device further comprises a duct substantially located within said device and connected to said plurality of channels in such a way as to form a path with sidewalls having gradual changes in hardness and capable of allowing the fluid to flow through the path.

17. The apparatus of claim 15, wherein each beam comprises a plurality of columns formed with a cushion material having gradual change in hardness along the height of said columns.

18. The apparatus of claim 15, wherein the device is interconnected to a unit comprising means for forcing the fluid through said path such that the fluid exiting the unit enters the device.

19. The apparatus of claim 18, wherein the unit further comprises a means for exchanging heat with the fluid such that the fluid exiting the device enters the unit.

20. The apparatus of claim 15, wherein the contact surface is replaceable.

21. The apparatus of claim 15, wherein the cushion material of said plurality of beams is segmented.

* * * * *